US007891309B2

(12) United States Patent
Driscoll et al.

(10) Patent No.: US 7,891,309 B2
(45) Date of Patent: Feb. 22, 2011

(54) SELF CONTAINED INTEGRATED MOORING SYSTEM

(75) Inventors: Frederick R. Driscoll, Pembroke Pines, FL (US); Pierre-Philippe Beaujean, Fort Lauderdale, FL (US); John Charles Frankenfield, Greenacres, FL (US)

(73) Assignee: Florida Atlantic University, Boca Raton, FL (US)

( * ) Notice: Subject to any disclaimer, the term of this patent is extended or adjusted under 35 U.S.C. 154(b) by 51 days.

(21) Appl. No.: 12/018,533

(22) Filed: Jan. 23, 2008

(65) Prior Publication Data

US 2008/0245285 A1 Oct. 9, 2008

Related U.S. Application Data

(60) Provisional application No. 60/886,418, filed on Jan. 24, 2007.

(51) Int. Cl.
*B63B 21/00* (2006.01)

(52) U.S. Cl. ..... 114/230.2; 114/230.23

(58) Field of Classification Search ..... 114/230.1, 114/230.2, 230.22, 230.23, 294; 441/7, 8, 441/11, 23, 30; 367/4
See application file for complete search history.

(56) References Cited

U.S. PATENT DOCUMENTS

| | | | | |
|---|---|---|---|---|
| 2,422,337 | A * | 6/1947 | Chilowsky | 441/11 |
| 2,752,615 | A * | 7/1956 | Parker | 441/8 |
| 3,291,092 | A * | 12/1966 | Halberg et al. | 114/295 |
| 3,385,252 | A * | 5/1968 | Sekkelsten | 114/230.23 |
| 4,186,370 | A * | 1/1980 | Cupolo et al. | 367/4 |
| 4,186,374 | A * | 1/1980 | Ouellette | 367/4 |
| 4,493,664 | A * | 1/1985 | Dale | 441/7 |
| 5,403,219 | A * | 4/1995 | Ryan | 441/11 |
| 7,001,235 | B2 * | 2/2006 | Baldwin | 441/30 |
| 7,179,145 | B2 * | 2/2007 | Driscoll et al. | 441/7 |

* cited by examiner

*Primary Examiner*—Lars A Olson
(74) *Attorney, Agent, or Firm*—Novak Druce + Quigg LLP; Gregory A. Nelson; Amy A. Dobbelaere

(57) ABSTRACT

A self contained integrated mooring system configured to contain items within a payload container in a water body is disclosed. The self contained integrated mooring system may include components for conveniently collecting and storing the components of the self contained integrated mooring system. The self contained integrated mooring system may be formed from the payload container, a mooring line handling and storage module, an anchor and a system container in a single system that eliminates having to work and rework anchor lines on a deck of a boat.

14 Claims, 6 Drawing Sheets

SELF CONTAINED INTEGRATED MOORING SYSTEM

CROSS-REFERENCE TO RELATED APPLICATION

This application claims the benefit of U.S. Provisional Patent Application No. 60/886,418 filed Jan. 24, 2007.

STATEMENT REGARDING FEDERALLY FUNDED RESEARCH

The U.S. Government has a paid-up license in this invention and the right in limited circumstances to require the patent owner to license others on reasonable terms as provided for by the terms of N0014-05-1-0005 awarded by the Office of Naval Research.

FIELD OF THE INVENTION

This invention is directed to underwater payload systems, and more particularly, underwater payload systems with mooring systems.

BACKGROUND

Underwater and surface floating payload systems have been used to position payloads at different positions in the water column relative to the surface and to the sea floor. Underwater and surface floating payload systems typically include payloads that are anchored to the sea floor with an anchor or mooring line or both, and connected to floatation, which can be on the surface or in the water column. The floatation may or may not house the payload. Before deployment, the mooring line, anchor, chain, or buoy, or all of these components, can be laid on the deck of a vessel, placed in a storage bin, or otherwise contained, which consumes deck space and can cause tangles to form in the mooring line. On deck, the anchor, mooring line, payload, and floatation are connected together but are distinctly different components. The depth at which the payload will be in the water is determined by the amount of mooring line between the anchor and the payload or the length of the mooring line between the floatation and the payload, which is established while on the deck of the vessel or before being loaded on the vessel. After connecting the mooring line to the floatation, anchor, and payload, the anchor is then deployed to the sea floor, followed by the payload and other components shortly thereafter. Another deployment methodology includes deploying the payload and other components before deploying the anchor. The payload may be positioned at or below the surface of the water.

The payload may be recovered by pulling the system aboard a vessel by hand, with a winch, or other systems to pull the mooring line, but which are not part of the underwater and surface floating payload system. When the payload container is retrieved, the mooring line is again placed on the deck of the vessel or in a storage bin or otherwise contained. To redeploy the payload container, the mooring line must be reworked again to ensure tangle-free, successful redeployment. Thus, a need exists for a more efficient manner of deploying and retrieving the payload container.

SUMMARY OF THE INVENTION

This invention is directed to a self contained integrated mooring system configured to contain items within a payload container in a water body. The self contained integrated mooring system may include components for conveniently collecting and storing the components of the self contained integrated mooring system. The self contained integrated mooring system may be formed from the payload container, a mooring line handling and storage module, an anchor and a system container.

The payload container may have an internal cavity configured to retain payload and a reuasble lid providing access to the internal cavity configured to retain payload. The self contained integrated mooring system may also include at least one anchor in communication with the mooring line handling and storage module. A mooring line handling and storage module in communication with the payload container and including at least one spool with mooring line wound thereon. The mooring line handling and storage module may be attached to the payload container at a head of the payload container. The mooring line handling and storage module may also include a driver, such as a motor, for rotating the spool. The mooring line handling and storage module may include a handle for rotating the spool. The mooring line handling and storage module may include at least one winder receiving adapter coupled to a shaft supporting the spool that is adapted to be attached to a drill to rotate the spools to retrieve the mooring line.

In one embodiment, the at least one spool may include a plurality of spools on a shaft. Adjacent walls of spools may include crossover slots enabling the mooring line to crossover spools. A multiple spool locking mechanism may be included and may be adapted to separately lock mooring line on each spool to prevent each spool from being pulled from each spool, thereby enabling the self contained integrated mooring system to be deployed at different depths by setting the locking mechanism before deployment.

The self contained integrated mooring system may also include a system container having at least a payload container receiving chamber, a mooring line handling and storage module receiving chamber, and an anchor receiving chamber. The inner surface of each of the chambers may be configured to match a shape of the payload container, the mooring line handling and storage module, and the at least one anchor to limit movement relative to the system container.

An advantage of this invention is that the self contained integrated mooring system contains an anchor, a payload container and a mooring line handling and storage module in a single system without having to work and rework anchor lines on a deck of a boat.

Another advantage of this invention is that the self contained integrated mooring system enables appropriate amounts of line to be let out for anchoring, thereby eliminating the need to work and rework anchor lines.

Yet another advantage of this invention is that the self contained integrated mooring system provides an efficient way of effectively controlling and storing small diameter mooring line, thereby eliminating the need to use large diameter anchor line and reducing the risk of tangles associated with small diameter mooring lines.

Another advantage of this invention is that the mooring line handling and storage module is attached directly to the payload, thereby reducing the overall size in contrast to conventional systems.

These and other embodiments and advantages will be discussed below.

DETAILED DESCRIPTION OF THE DRAWINGS

Figure 1:
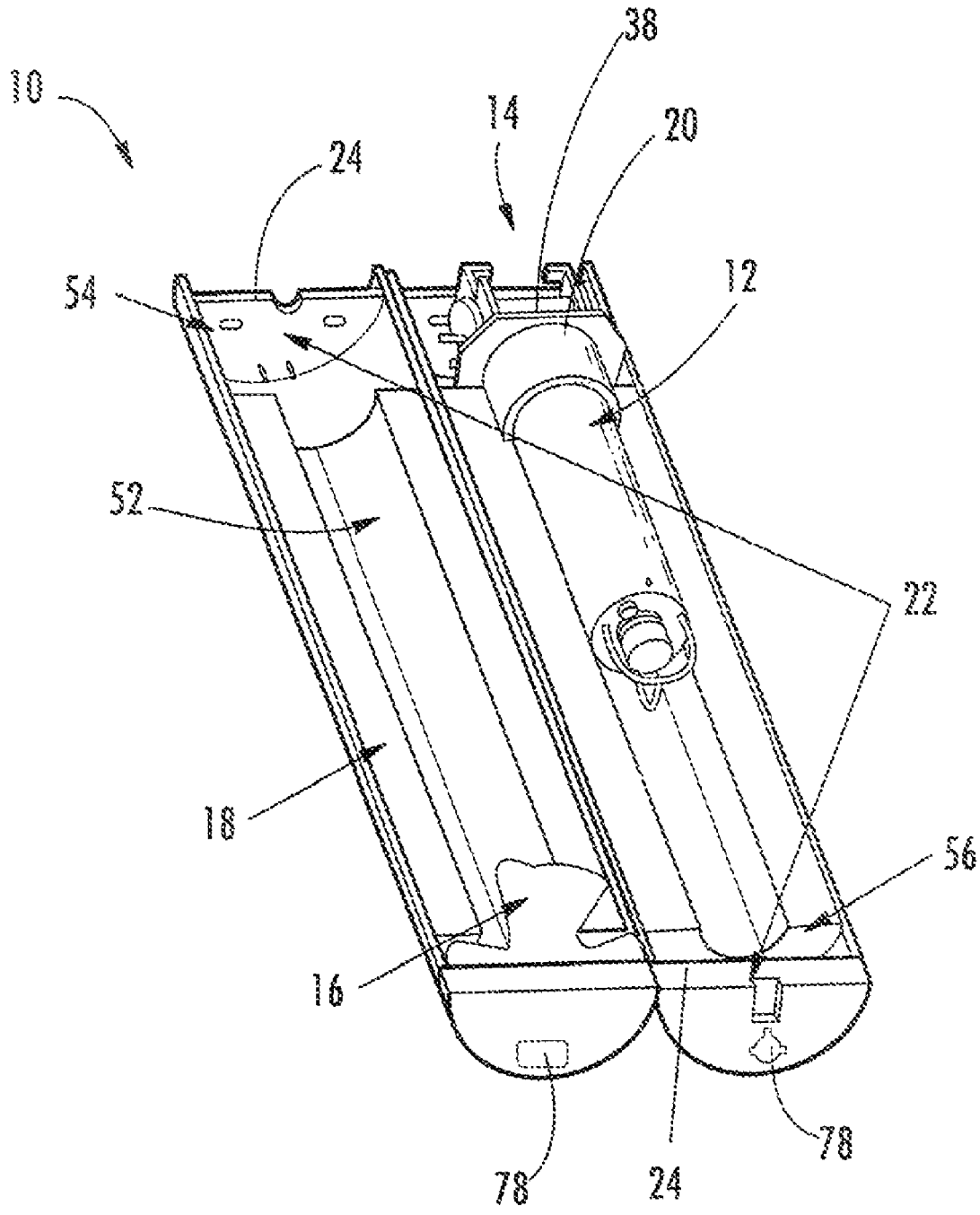
FIG. 1 is a perspective view of an embodiment of the self contained integrated mooring system of this invention.

As shown in FIGS. 1-6, the invention is directed to a self contained integrated mooring system 10 configured to contain items within a payload container 12 in a water body. The self contained integrated mooring system 10 may be an underwater or surface floating system. The self contained integrated mooring system 10 may include or one more of the following components: an integrated system container 18, payload 12, a mooring line handling and storage module 14, an anchor 16, mooring line, chain, and other appropriate components of a mooring system, such as, but not limited to, shackles and swivels. The self contained integrated mooring system 10 may include components for conveniently collecting and storing the components of the self contained integrated mooring system 10. The self contained integrated mooring system 10 may be formed from a system container 18 that is positively buoyant, negatively buoyant or neutrally buoyant.

As shown in FIG. 1, the payload 12 may be formed from a container adapted to contain the payload components, which, may be, but is not limited to, batteries, electronics, a transducer for underwater acoustic communication and positioning system, and other appropriate items. In particular, the payload container 12 may include an internal cavity 20 configured to retain the payload components. The internal cavity 20 may have any appropriate size and shape, which is dependent upon the size of the components and the particular application for which the self contained integrated mooring system container 10 is designed.

The system container 18 may also include one or more lids 22, which may be a reusable lid, attached to the system container 18 to seal one or more openings 24 in the payload container that facilitates access to the internal cavity 20. The lid 22 may include seals to seal the internal cavity 20 to prevent water intrusion when the system container 18 is deployed in water. The lid 22 may be multipurpose and include antennas 78. The system container 18 may include a handle to facilitate handling of the container 12. The system container 18 may be formed from any appropriate material or combinations of materials, such as, but not limited to, stainless steel, aluminum, fiberglass, epoxy, foam, and plastic.

The system container 18 may also contain or be attached to a mooring line handling and storage module 14 that is configured to contain a mooring line 28. The mooring line handling and storage module 14 may be in communication with the payload container 12 or other components. The mooring line handling and storage module 14 may be formed from one or more spools 30 configured to store the mooring line 28. The mooring line 28 can include, but is not limited to, plastic rope, wire rope, armored cable with internal optical and electrical conductors, monofilament line, chain, fishing line and any combination thereof. The mooring line 28 may be formed from diameters, such as about ⅛ of an inch, which are much less than conventional anchor lines because the mooring line handling and storage module 14 contains the line and prevents the line from tangling, which is typical of unconfined, thin diameter lines. Use of the smaller diameter lines by the mooring line handling and storage module 14 enables longer lines to be used, thereby permitting the self contained integrated mooring system 10 to be deployed in deeper water.

Figure 6:
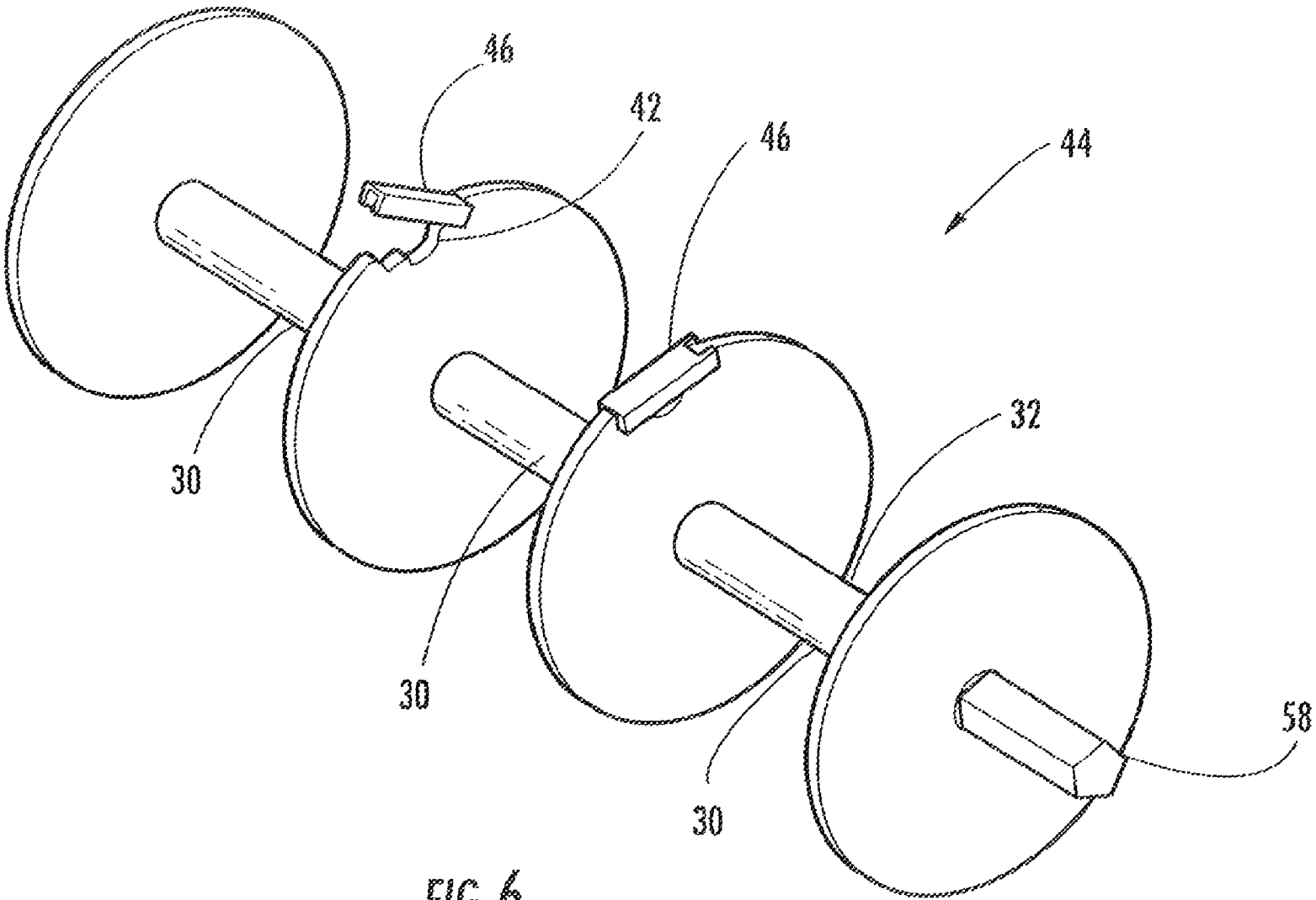
FIG. 6 is perspective view of spools of the mooring line handling and storage module.

The spools 30 may be supported by a single shaft 32. The shaft 32 may be attached to a driver 34, such as a motor, an electric motor, a mechanical winder, or an electro-mechanical winder, or handle 36, or both, for rotating the shaft 32 and spools 30, to retrieve the mooring line 28 onto the spool 30. One or more winder receiving adapters 58, as shown in FIG. 6, may be coupled to the shaft 32 supporting the spool 30. The winder receiving adapter 58 may be adapted to be attached to a drill or other mechanical or electrical system to rotate the spools to retrieve the mooring line. A drill, such as, but not limited to, a cordless drill, or other appropriate rotary device may be used to rotate the shaft 30 to retrieve mooring line 28 and store it on the spool 30.

The mooring line handling and storage module 14 may be fixedly attached to the payload container 12 or attached via a line. The mooring line handling and storage module 14 may be attached to the system container 18 or may be a stand alone unit not attached to any of the components of the self contained integrated mooring system 10. In at least one embodiment, the mooring line handling and storage module 14 may be attached to a head 38 of the payload 12 in a position enabling the mooring line 28 to be paid out of the mooring line handling and storage module 14 and attached to the anchor 16. The mooring line handling and storage module 14 may be attached to the head such that the mooring line handling and storage module 14 is in proper orientation to prevent the payload 12 from being damaged when mooring line 28 is being paid out or retrieved and to reduce torque on the payload 12. In at least one embodiment, a sleeve 62 extending from the mooring line handling and storage module 14 extends partially over the payload 12. Attaching the mooring line handling and storage module 14 directly to the payload 12 reduces the overall size of the system. In at least one embodiment, the payload 12 may include a plurality of studs 64 that may be inserted through orifices in the mooring line handling and storage module 14. The mooring line handling and storage module 14 may be retained in position with clips 66 attached to grooves in the studs 64. The mooring line handling and storage module 14 may be attached in other appropriate ways as well. The mooring line 28 may be feed through a guide at a base 40 of the payload 12 to keep the payload container positioned upright when deployed.

Figure 2:
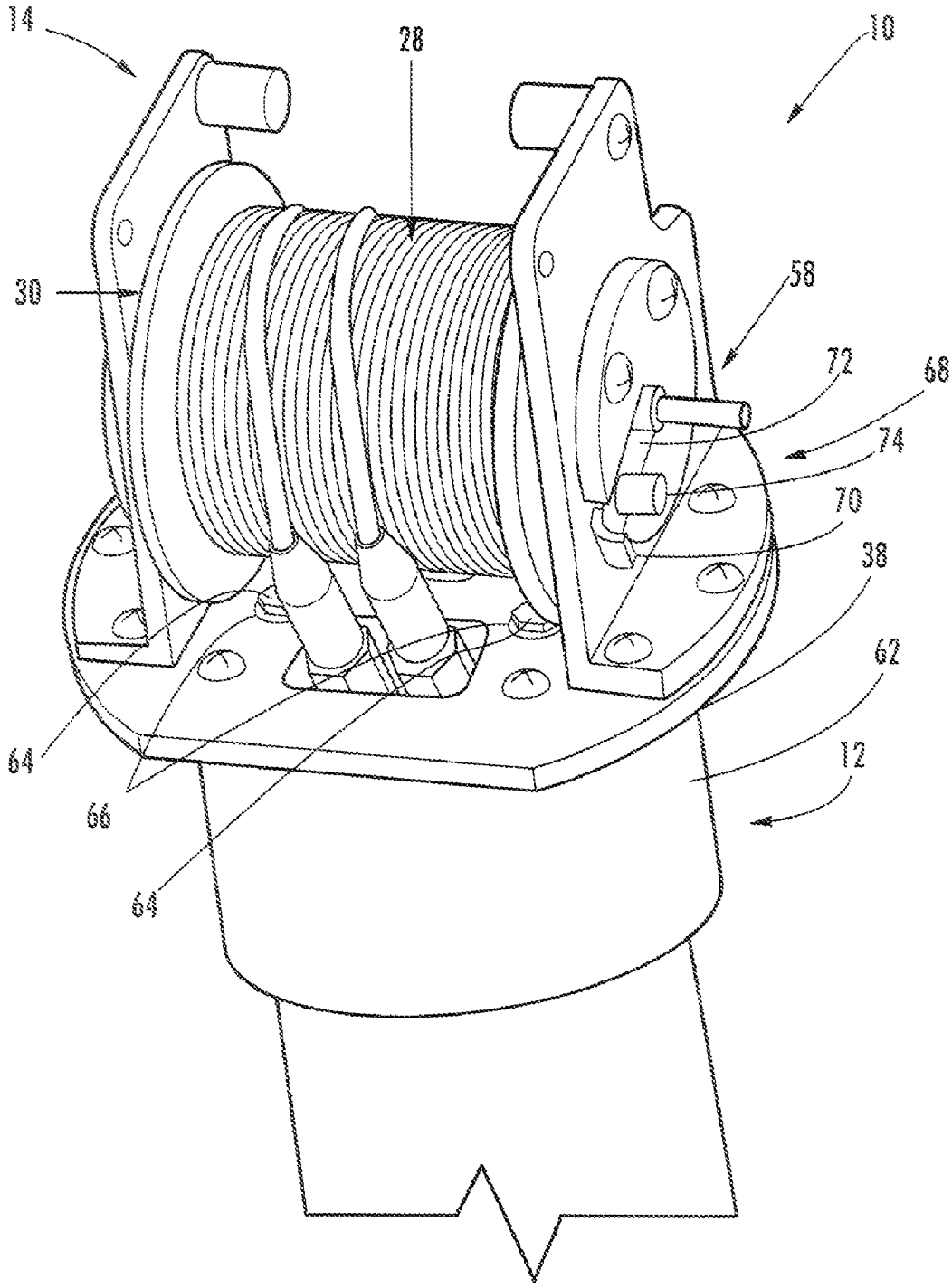
FIG. 2 is a perspective view of a mooring line handling and storage module of this invention.

As shown in FIG. 2, the mooring line handling and storage module 14 may also include a locking mechanism 68 that is configured to prevent the spool 30 from rotating such that after an amount of mooring line 28 is paid out, the spool 30 may be prevented from being rotated. In one embodiment, the locking mechanism 68 may be formed from a latch 70 configured to slide within a channel 72. The latch 70 may be slide into contact with the shaft 58. In one embodiment, the shaft 58 may be generally square, and the latch 70 may be configured to engage the shaft 58 to prevent the shaft 58 from rotating. The latch 70 is held in place with a set screw 74. The locking mechanism 68 may be formed from other appropriate systems as well and is not limited to this particular configuration.

In at least one embodiment, as shown in FIG. 6, the mooring line handling and storage module 14 may include a plurality of spools 30. The spools 30 may be positioned adjacent to each other on a shaft 32. The spools 30 may include crossover slots 42 enabling a single mooring line 28 to be wrapped around a spool 30 and crossover and continue to be wrapped on adjacent spools 30. A multiple spool locking mechanism 44, as shown in FIG. 6, may be used to control which spools 30 are able to be rotated. The multiple spool locking mechanism 44 may be any appropriate locking mechanism.

In at least one embodiment, the multiple spool locking mechanism 44 may be formed from a latch 46 configured to close down upon the mooring line 28 in the slots 42 to prevent the mooring line 28 from coming off of the spool 30. The latch 46 may be sized to prevent a mooring line 28 from being pulled out of the slot 42 once the latch 46 is placed in a closed position. As a result, the latches 46 may prevent the spools 30 from spinning and releasing mooring line 28 from the spools 30. Each spool 30 may be loaded with a known length of mooring line 28, such as, but not limited to, one hundred feet. If the payload container 12 is desired to be anchored 100 feet from the sea floor, the multiple spool locking mechanism 44 may be positioned such that one of the spools 30 may rotate. Thus, when the anchor 16 is dropped overboard from a vessel, the free spool 30 may rotate and deploy one hundred feet of mooring line 28. Therefore, this configuration may assist in deploying the self contained integrated mooring system 10 to a known distance above the sea floor by adjusting a multiple spool locking mechanism 44.

Figure 3:
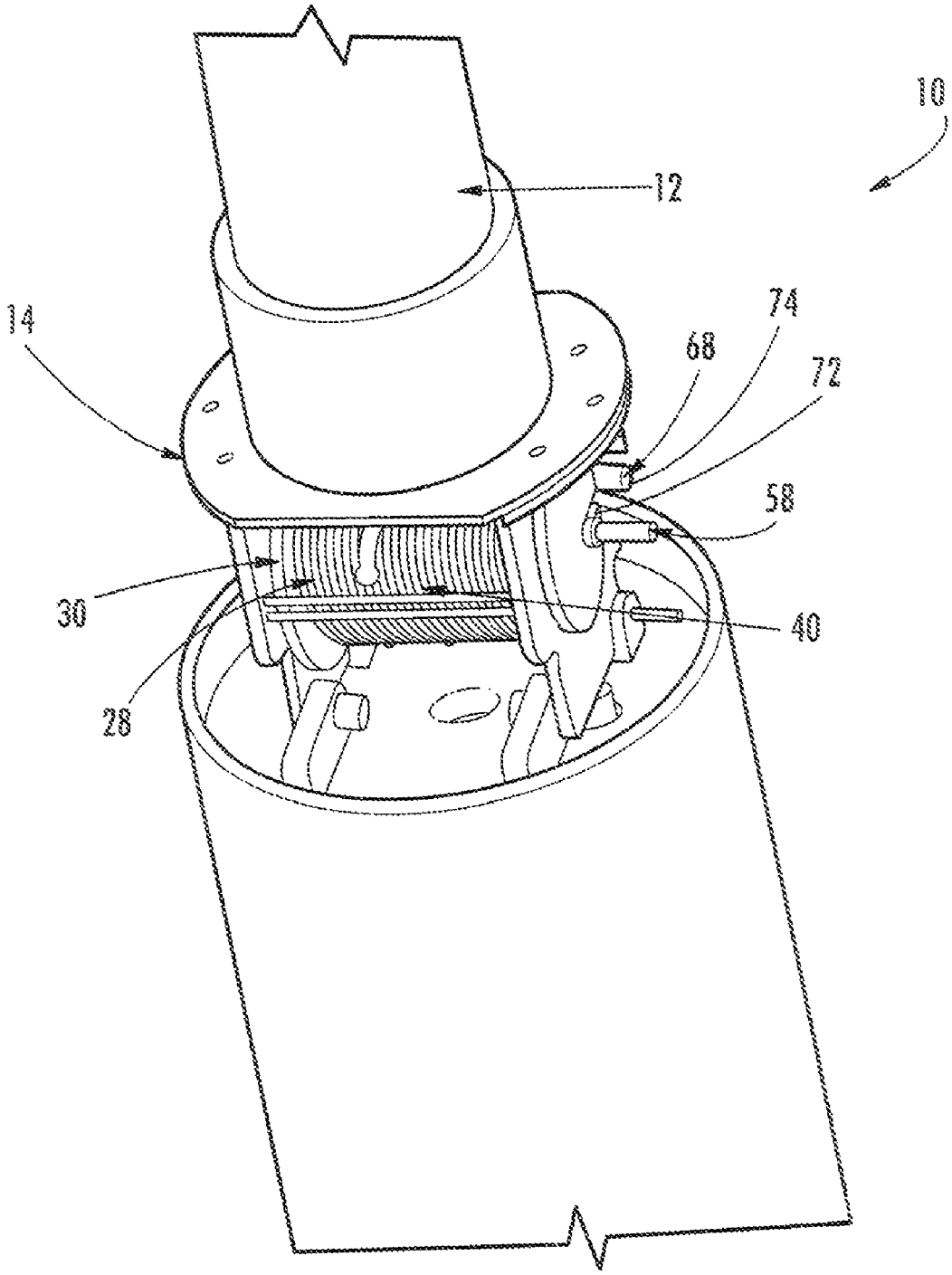
FIG. 3 is another perspective view of the mooring line handling and storage module fixedly attached to the system container.
Figure 4:
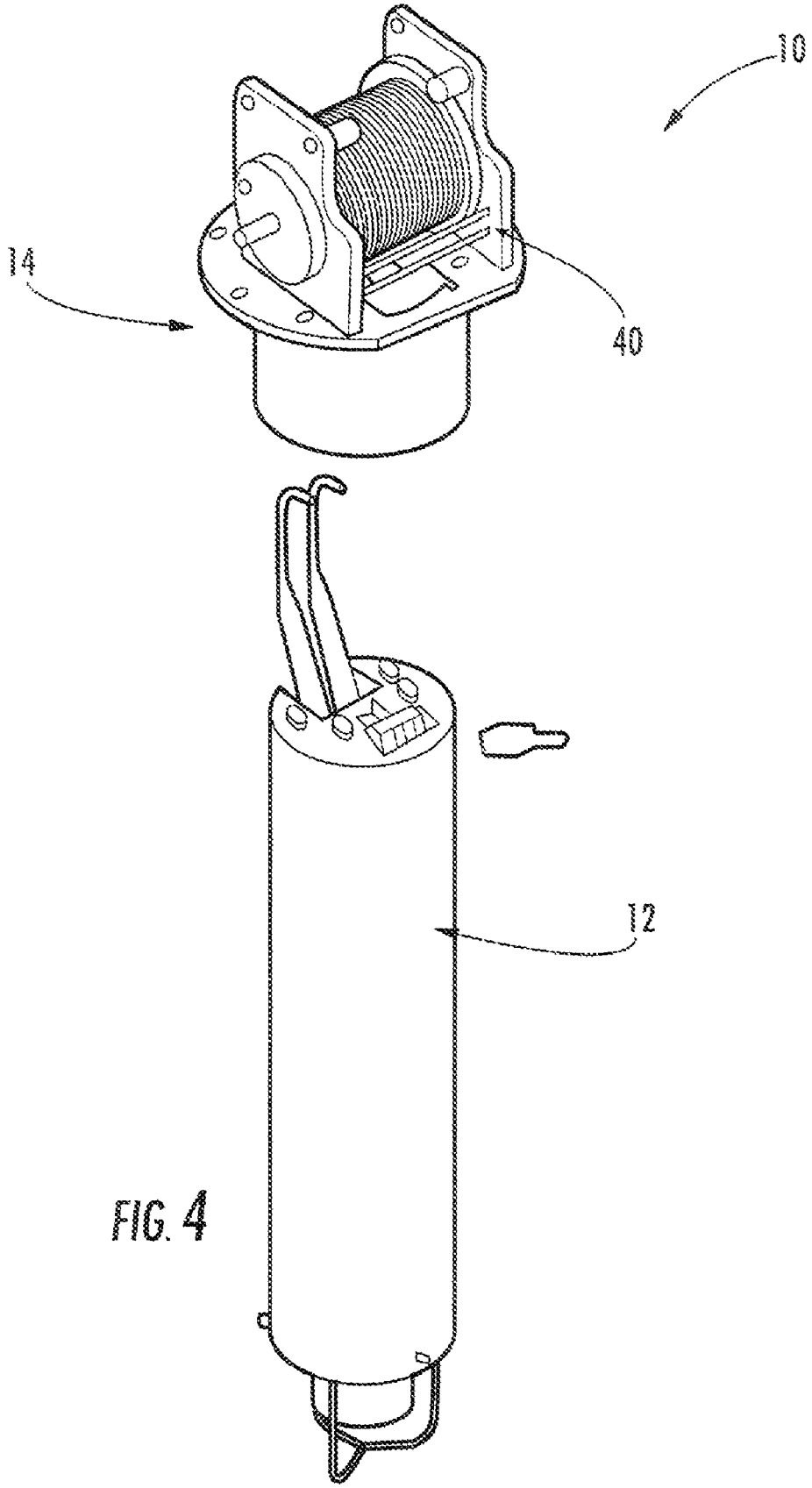
FIG. 4 is a partial exploded perspective view of the mooring line handling and storage module and payload.
Figure 5:
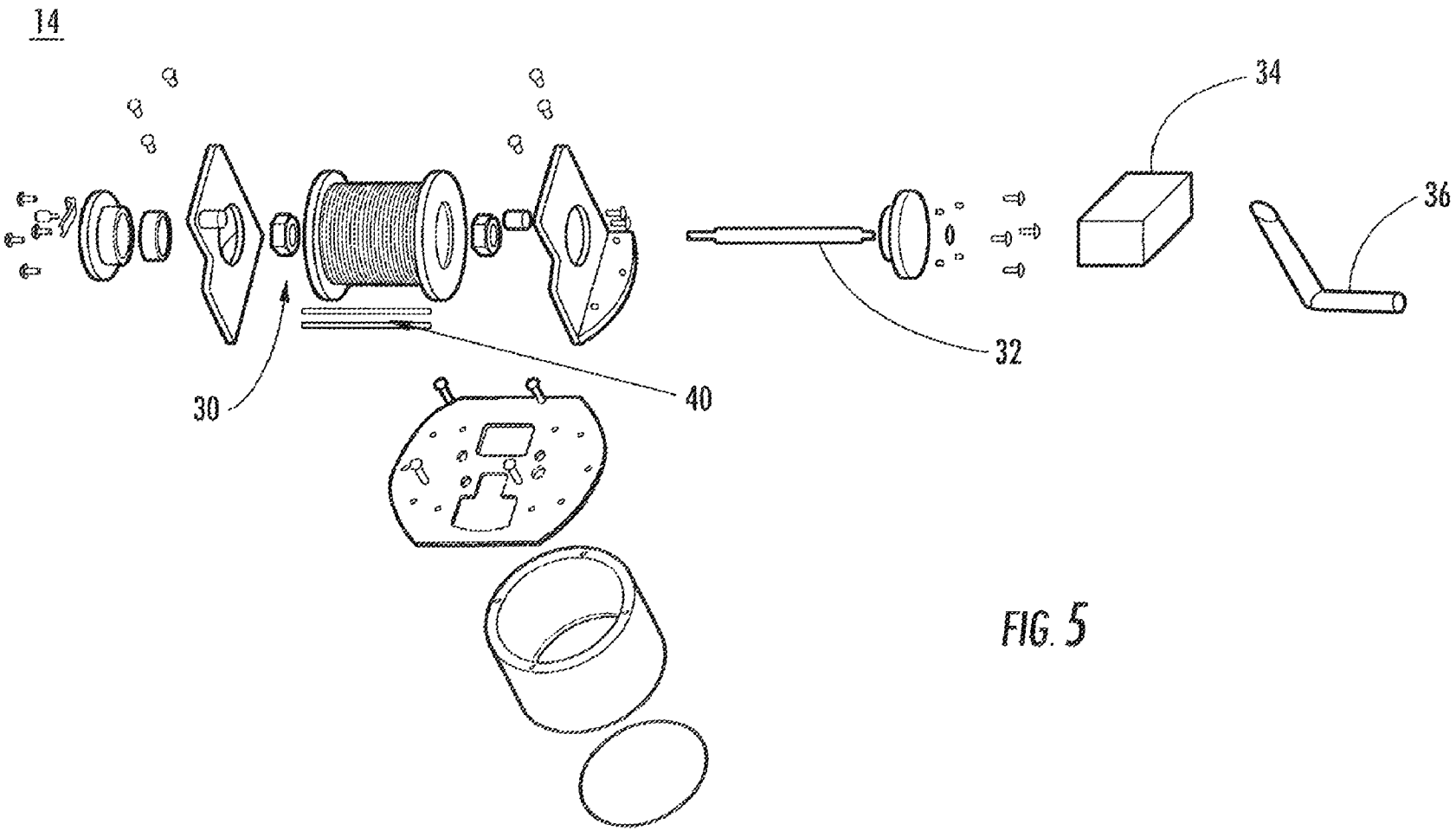
FIG. 5 is an exploded perspective view of the mooring line handling and storage module.

In the embodiment shown in FIGS. 2 and 3, the spool 30 is designed so that a user disengages the locking mechanism 68 to deploy the anchor 16 and mooring line 28. The rate of the mooring line 28 leaving the spool 30 may be controlled by a user's hand, by attaching a drill to the shaft 58 so that resistance of the drill slows the spool 30, and by engaging the locking mechanism 68. Once the correct amount of line is deployed, the line-lock mechanism is re-engaged. To retrieve the line, either the handle 36 is attached to, or folded out from the mechanism, and the mooring line 28 is manually retrieved. Alternatively, a driver 34 such as a mechanical or electro-mechanical system 34 can be used to replace the handle 36 for faster and automatic retrieval. Gears may be used to change the wind-in ratio (the ratio between the number of handle rotations and the spool rotations). In some embodiments, hundreds of feet of mooring line 28 may be retrieved in about thirty seconds, thereby greatly expediting the anchor 16 retrieval process over conventional systems.

The self contained integrated mooring system 10 may also include at least one anchor 16 that may or may not be in communication with the mooring line handling and storage module 14. The configuration of the anchor 16 may differ based on the intended application. The anchor 16 may have any appropriate configuration and is not limited to one particular anchor design.

As shown in FIG. 1, the self contained integrated mooring system 10 may also include a system container 18. The system container 18 may act to support the payload 12 in the water column and may act as a storage case when the system 10 is not being used. The system container 18 may partially house all of the components of the system 10 and include at least a payload container receiving chamber 52 and a mooring line handling and storage module receiving chamber 54. The anchor 16 may connect to the payload container 12, and the payload container 12 may in turn be attached, either fixedly or by lines, to the system container 18. The connected payload container 12 and anchor 16 may partially fit inside the system container 18.

In another embodiment, the system container 18 may completely house all of the components of the system 10. The system container 18 may include at least a payload container receiving chamber 52, a mooring line handling and storage module receiving chamber 54, and an anchor receiving chamber 56, and other mooring and system components. The inner surface of each of the chambers 52, 54, 56 may be configured to match a shape of the payload container 12, the mooring line handling and storage module 14, and the at least one anchor 16, and other mooring and system components, respectively to limit movement relative to the system container 18. As shown in FIG. 1, the system container 18 may be formed from two halves. The system container 18 may be formed from any appropriate material capable of protecting the components of the self contained integrated mooring system 10. The system container 18 may be restrained in the closed position with straps or other appropriate latching devices.

The system container 18 may also include flotation enabling the system container 18 to function as a buoy within the system 10. The system container 18 may include enough flotation to float the system container 18 together with the components. The system container 18 may also be fitted with, or integrated with, support antennas 78.

We claim:

1. A self contained integrated mooring system, comprising:

a payload container having an internal cavity configured to retain payload;

a mooring line handling and storage module in communication with the payload container and including at least one spool with mooring line wound thereon;

at least one anchor in communication with the mooring line handling and storage module; and a system container, wherein the payload container, the mooring line handling and storage module and the at least one anchor are removably stored within the system container.

2. The self contained integrated mooring system of claim 1, wherein the system container comprises at least one of a payload container receiving chamber, a mooring line handling and storage module receiving chamber, and an anchor receiving chamber, wherein an inner surface of each of the chambers is configured to match a shape of the payload, the mooring line handling and storage module, and the at least one anchor to limit movement relative to the system container.

3. The self contained integrated mooring system of claim 1, wherein the mooring line handling and storage module is attached to the payload container at a head of the payload container.

4. The self contained integrated mooring system of claim 3, wherein the mooring line handling and storage module further comprises a driver for rotating the spool.

5. The self contained integrated mooring system of claim 3, wherein the mooring line handling and storage module further comprises a handle for rotating the spool.

6. The self contained integrated mooring system of claim 1, further comprising a reusable lid providing access to the internal cavity configured to retain payload.

7. The self contained integrated mooring system of claim 1, wherein the at least one spool comprises a plurality of spools on a shaft, wherein adjacent walls of spools include crossover slots enabling the mooring line to crossover spools, and including a multiple spool locking mechanism adapted to separately lock mooring line on each spool to prevent each spool from being pulled from each spool, thereby enabling the self contained integrated mooring system to be deployed at different depths by setting the locking mechanism before deployment.

8. The self contained integrated mooring system of claim 1, wherein the mooring line handling and storage module further comprises at least one winder receiving adapter coupled to a shaft supporting the spool that is adapted to be attached to a drill to rotate the spools to retrieve the mooring line.

9. The self contained integrated mooring system of claim 1, wherein the system container includes flotation such that the system container is buoyant, whereby the system container functions as a buoy.

10. A self contained integrated mooring system, comprising:

a payload container having an internal cavity configured to retain payload and a lid providing access to the internal cavity configured to retain payload;

a mooring line handling and storage module in communication with the payload container and including a plurality of spools with mooring line wound thereon, wherein the mooring line handling and storage module is attached to the payload container at a head of the payload container;

wherein the plurality of spools are positioned on a shaft, wherein adjacent walls of spools include crossover slots enabling the mooring line to crossover spools, and including a multiple spool locking mechanism adapted to separately lock mooring line on each spool to prevent each spool from being pulled from each spool, thereby enabling the self contained integrated mooring system to be deployed at different depths by setting the locking mechanism before deployment; and a system container having at least a payload container receiving chamber, a mooring line handling and storage module receiving chamber, and an anchor receiving chamber, wherein an inner surface of each of the chambers is configured to match a shape of the payload container, the mooring line handling and storage module, and the at least one anchor to limit movement relative to the system container.

11. The self contained integrated mooring system of claim 10, further comprising at least one anchor in communication with the mooring line handling and storage module.

12. The self contained integrated mooring system of claim 10, wherein the mooring line handling and storage module further comprises a driver for rotating the spools.

13. The self contained integrated mooring system of claim 10, wherein the mooring line handling and storage module further comprises a handle for rotating the spools.

14. The self contained integrated mooring system of claim 10, wherein the mooring line handling and storage module further comprises at least one winder receiving adapter coupled to the shaft supporting the spools that is adapted to be attached to a drill to rotate the spools to retrieve the mooring line.

* * * * *